United States Patent [19]

Naka et al.

[11] 4,410,435

[45] Oct. 18, 1983

[54] LITHIUM COMPLEX GREASE AND ITS PRODUCING METHOD

[75] Inventors: Michiharu Naka; Takayuki Yatabe, both of Fujisawa; Hideki Koizumi, Kamakura, all of Japan

[73] Assignee: Nippon Seiko Kabushiki Kaisha, Tokyo, Japan

[21] Appl. No.: 335,389

[22] Filed: Dec. 29, 1981

Related U.S. Application Data

[63] Continuation-in-part of Ser. No. 169,929, Jul. 17, 1980, abandoned.

[30] Foreign Application Priority Data

Aug. 16, 1979 [JP] Japan ..... 54-103513

[51] Int. Cl.[3] ..... C10M 1/54

[52] U.S. Cl. ..... 252/42.1

[58] Field of Search ..... 252/42.1

[56] References Cited

U.S. PATENT DOCUMENTS

| | | | |
|---|---|---|---|
| 2,232,421 | 2/1941 | Workman | 252/42.1 X |
| 2,721,844 | 10/1955 | Culnane et al. | 252/42.1 |
| 2,737,493 | 3/1956 | Butcosk | 252/42.1 X |
| 2,750,341 | 6/1956 | Morway et al. | 252/42.1 X |
| 2,872,417 | 2/1959 | Jordan et al. | 252/42.1 |
| 2,898,296 | 8/1959 | Patenden et al. | 252/41 X |
| 3,214,376 | 10/1965 | Morway | 252/42.1 X |

*Primary Examiner*—Andrew Metz

*Attorney, Agent, or Firm*—Michael J. Striker

[57] ABSTRACT

A lithium complex grease for rolling bearings which has high dropping points and is capable of maintaining for a long time an excellent stability of a thickener micell under a high temperature, high adhesion, heat resistance, water resistance, rust resistance, load resistance, low noises and other high-level properties and a method of producing such lithium complex grease. The lithium complex greases are characterized in that base greases containing a base oil, a fatty acid having 12 to 24 carbon atoms, a dicarboxylic acid having 4 to 12 carbon atoms and/or a dicarboxylic acid ester and a lithium hydroxide are thickened with a phosphate ester and/or a phosphite ester. A method of producing the lithium complex greases is characterized in that the base greases having the above composition are added by the phosphate ester and/or the phosphite ester, and thickened under a reaction at a temperature of more than 210° C. (410° F.).

8 Claims, No Drawings

LITHIUM COMPLEX GREASE AND ITS PRODUCING METHOD

CROSS-REFERENCE TO A RELATED APPLICATION

This application is a continuation-in-part of the application Ser. No. 169,929 filed July 17, 1980 and now abandoned.

BACKGROUND OF THE INVENTION

This invention relates to lithium complex greases for rolling bearings which have high dropping points and are capable of maintaining for a long time an excellent stability of a thickener micelle under a high temperature, high adhesion, heat resistance, water resistance, rust resistance, load resistance, low noises and other high-level properties. This invention also provides a method of producing such lithium complex greases.

Because conventional greases for rolling bearings are of a relatively good heat resistance, a relatively good water resistance, less intermixing of foreign substances and a reasonable price, lithium soap greases have mainly been used in practice. However, the disadvantage of the lithium soap greases is that as its use circumstances are over 130° C. (266° F.) at temperature, the greases are leaked from a rolling bearing due to micelle destruction caused by oxidation, a decline of adhesive force, a grease softening, an increase of oil separation, or the like.

In order to overcome the disadvantages of the foregoing lithium soap greases, various kinds of non-soap base greases and complex greases having a very high dropping point and a heat resistance have been developed.

However, when they are used for a long time, the non-soap base greases are liable to be hardened, while the complex greases are liable to be softened extremely. Further, when a fluorine oil as a base oil is used, its price is too expensive. Accordingly, its utilization is limited.

On the other hand, the circumstances of use of the greases are becoming severer and severer in connection with miniaturization of mechanical devices and high speed of operating devices. For example, like bearings which are employed in operating equipment in an automobile, when the grease is used in the proximity of such a power source as engine, the lubricating greases for the bearings are subject to particularly high temperature conditions for a long time. In the above circumstances, the grease must have a high temperature resistance, a sufficient life durability and a water resistance. Namely, in view of various properties, it must be much more superior to the lithium soap greases as mentioned above. Today, it is demanded to develop a novelty heat-resisting grease which can assure a long life of lubrication and has removed the defects of the conventional non-soap greases and various complex greases.

Conventionally, there are known various kinds of complex greases employing various lithium soaps. Some of them are disclosed in U.S. Pat. No. 2,872,417, 2,898,296 and so on. According to U.S. Pat. No. 2,872,417, the lithium grease is produced by a base oil, a fatty acid and more excessive lithium hydroxide than an equivalent weight necessary for saponification.

After dehydration, the lithium grease is added by a phosphite ester or a phosphate ester, and a high dropping point lithium base grease is obtained.

According to various information which the inventors of this Application have so far collected, the lithium greases according to the above U.S. Pat. No. 2,872,417 have not appeared yet on the market. Further, the inventors have tested a grease sample which was produced by the compositions as described within the scope of the claims of the above U.S. Patent, and found that the grease obtained thus had no high dropping point as a heat-resisting grease.

A lithium complex grease according to U.S. Pat. No. 2,898,296 is produced by saponifying a fatty acid and a dicarboxylic acid ester with a lithium hydroxide. In this lithium complex grease, when a dicarboxylic acid is employed in lieu of the dicarboxylic acid ester, it has been confirmed that a dropping point of the grease is no more than 182.2° C. (360° F.) and its required purpose cannot be attained. A lithium complex grease similar to U.S. Pat. No. 2,898,296 has already been put on the market. The inventors of this Application have examined the effect of the above lithium complex grease by carrying out a heat resistance rotation test of the bearings. The result was that its lubrication life was much worse than that of a product intended by the inventors.

SUMMARY OF THE INVENTION

Accordingly, it is a general object of this invention to provide lithium complex greases and their producing method, wherein the lithium complex greases maintain a high dropping point, an excellent thickener micelle stability and a high adhesion which is a key point of lubrication life, so that they can be used for a long time at a high temperature of more than 130° C. (266° F.). The lithium complex greases having such excellent properties can be used effectively in a very severe use condition, for example, in operating devices of a car. To attain this object, the lithium complex greases are provided in which base greases are produced by mixing and dispersing a base oil, a fatty acid, a dicarboxylic acid and/or a dicarboxylic acid ester and a lithium hydroxide, the base greases being added with a phosphate ester and/or a phosphite ester, and thickened under a reaction at a temperature of more than 210° C. (410° F.).

Other and further objects, features and advantages of this invention will be apparent from the following description.

DETAILED DESCRIPTION OF THE INVENTION

A base oil to be used in this invention is either one of a normal mineral oil, a synthetic hydrocarbon oil, a synthetic ester oil and the like, or a mixture thereof. Generally, these materials have the viscosity range of about 5–500 cst at a temperature of 40° C. (104° F.). The synthetic oil is preferably used by e.g. dicarboxylic acid ester such as di-2-ethylhexyl sebacate or hindered ester such as trimethylolpropane caprylic acid ester and pentaerythritol caprylic acid ester, or dipentaerythritol capron acid ester or the like. Still further, polyglycol oil, silicone oil, polyphenyl ether oil, perfluoropolyether oil, halogenation hydrocarbon oil, alkyl benzene oil, etc are usable as a synthetic oil.

A fatty acid which is used when producing lithium complex greases according to this invention has about 12 to 24 carbon atoms, preferably about 16 to 20 carbon atoms. More preferably, the fatty acid consists of a stearic acid.

A dicarboxylic acid has about 4 to 12 carbon atoms, preferably about 6 to 10. More preferably, the dicarboxylic acid consists of a sebacid acid, an azelaic acid and the like.

A dicarboxylic acid ester has the same carbon atom numbers as the dicarboxylic acid. More preferably, it consists of di-2-ethylhexil sebacate, di-2-ethylhexyl-azelate and the like.

A soap content is used in an amount of 2 to 30 weight percent out of the grease 100 weight percent.

Further, a phosphate ester of and/or a phosphite ester of either aliphatic series or aromatic series are or is added to the base grease containing the above ingredients in order to provide the grease according to this invention with heat resistance and high adhesion. Tricresyl phosphate is the most suitable addition agent for this purpose.

Still further, it is preferable to add to the base greases containing the above ingredients oxidation inhibitors, rust and corrosion inhibitors, extreme pressure additives, viscosity index improvers, oilness agents, dyes, etc if necessary. Thus, the properties of the greases according to this invention are improved furthermore.

For the purpose of obtaining the lithium complex greases of this invention, the following process is inevitable.

Base greases are produced by mixing and dispersing a base oil, a fatty acid, a dicarboxylic acid and/or dicarboxylic acid ester and a lithium hydroxide. Following to this, the base greases are added by a phosphate ester and/or a phosphite ester, and thickened under a reaction at a temperature of more than 210° C. (410° F.). As a result, the greases have obtained higher consistency and higher adhesion than the base greases.

Preferred examples of the lithium complex greases according to this invention will now be described. In Example 1, various properties including a dropping point have been tested and their data are given. Because a high dropping point is a first indispensable requisite, we have measured only the dropping point in other examples and tests.

EXAMPLE 1

500 grams of polyol ester oil, 129 grams of di-2-ethylhexyl sebacate and 120 grams of stearic acid were retained in a reacting container, mixed and agitated therein up to 70° C. (158° F.). Then, the stearic acid was dissolved completely. Next to this, a water solution containing 44 grams of lithium hydroxide enough to react with di-2-ethylhexyl sebacate and stearic acid was added to the mixture. Then, the mixture was sufficiently agitated, heated, saponified and dehydrated. Further, it was heated up to 200° C. (329° F.) and the soap content was completely dissolved. Then, 50 grams of tricresyl phosphate was added to the mixture (base grease), and the mixture was heated to 240° C. (464° F.). While keeping agitation for fifteen minutes, the base grease was reacted with tricresyl phosphate.

After the grease was reduced to a temperature of 60° C. (140° F.), a roll treatment was carried out. Still further, 32 grams of additives dissolved in 134 grams of polyol ester oil were added to the grease. One day later after deareation, various properties of the grease obtained thus were measured. Table 1 shows the ingredients of the grease and its various properties.

TABLE 1

| Composition in Example 1 and Its Properties | |
|---|---|
| Composition | Weight (%) |

TABLE 1-continued

| Composition in Example 1 and Its Properties | |
|---|---|
| Polyol ester oil | 63.4 |
| Stearic acid | 12.0 |
| Di-2-ethylhexyl sebacate | 12.0 |
| Lithium hydroxide hydrate | 4.4 |
| Tricresyl phosphate | 5.0 |
| Additives | 3.2 |

| Testing items | Testing method | Properties |
|---|---|---|
| Dropping point | JIS K-2561 | 247° C. (477° F.) |
| Consistency | | |
| OW (Unworked penetration), 25° C. (77° F.) | JIS K-2560 | 237 |
| 60W (Penetration after 60 strokes), 25° C. (77° F.) | JIS K-2560 | 281 |
| $10^5$W (Penetration after 100,000 strokes), 25° C. (77° F.) | JIS K-2571 | 343 |
| Oil Separation 100° C. (212° F.), 30 hrs. | JIS K-2570 | 1.5% |
| Oxidation stability 98.9° C. (210° F.) 100 hrs. | JIS K-2569 | 0.3 kg/cm$^2$ |
| Evaporation loss 98.9° C. (210° F.) 22 hrs. | JIS K-2565B | 0.43% |
| Water washout 38° C. (100° F.) 1 hr. | JIS K-2572 | 5.4% |
| Low temperature torque −20° C. (−68° F.) | | |
| Starting torque | ASTM D-1478 | 1463g-cm |
| Running torque | | 585g-cm |
| Corrosion by a heating copper plate 100° C. (212° F.), 24 hrs. | JIS K-2567 | Passed |
| Rust test Pure water 52° C. (126° F.), 48 hrs. 100% RH | ASTM D-1743 | Passed |
| Load carrying capacity (Soda's four-ball method) 200 rpm 0.5 kg/cm$^2$/min. | JIS K-2519 | 7.5 kg |
| Ash content | JIS K-2563A | 3.6% |

EXAMPLE 2

66.9 weight percent of mineral oil (#180 Turbine oil) was used as a base oil. It was mixed with a thickner comprising 12 weight percent of stearic acid, 12 weight percent of di-20 ethylhexyl sebacate, 4.1 weight percent of lithium hydroxide and 5 weight percent of tricresyl phosphate. The thickner had been produced in the same way as Example 1. None of additives was added to the mixture. We had conducted a dropping point test of the grease obtained in Example 2 by means of JIS K-2561 test. The result was that its dropping point was raised to a desired temperature 260° C. (500° F.).

EXAMPLES 3, 4, 5, 6, 7 and 8

As shown in Table 2, each grease in those Examples has various formulations. Each of them was produced in the same conditions as Example 1. As seen from Table 2, it is understood that the dropping point of each lithium complex grease obtained in Examples 3, 4, 5, 6, 7 and 8 respectively amounts to more than 230° C. (446° F.).

For making a comparison, Table 2 describes the Test 1 of the grease corresponding to U.S. Pat. No. 2,872,417 and the Test 2 of the grease corresponding to U.S. Pat. No. 2,898,296. Each of both greases lacks an indispensable ingredient contained in the grease according to this invention. The former Patent (Test 1) lacks addition of dicarboxylic acid ester, while the latter Patent (Test 2)

lacks addition of the phosphate ester and the phosphite ester. The test result was that both greases as mentioned above showed a low dropping point and are not suitable for a practical use.

TABLE 2

| Composition in Examples 3, 4, 5, 6, 7, 8 respectively | | | | | | | | |
|---|---|---|---|---|---|---|---|---|
| | Example | | | | | | | |
| Composition | 3 | 4 | 5 | 6 | 7 | 8 | Test 1 | Test 2 |
| (Base oil) | | | | | | | | |
| Polyol ester oil | 66.9 | 66.9 | 66.9 | 64.3 | 66.9 | 66.9 | 70 | 72 |
| (Fatty acid) | | | | | | | | |
| Stearic acid | 12 | 12 | | 12 | 12 | | 20 | 12 |
| 12-hydroxystearic acid | | | 12 | | | 12 | | |
| (Dicarboxylic acid ester) | | | | | | | | |
| Di-2-ethylhexyl sebacate | 12 | 12 | 12 | | 12 | 12 | | 12 |
| (Dicarboxylic acid) | | | | | | | | |
| Sebacic acid | | | | 12 | | | | |
| (Lithium hydroxide) | | | | | | | | |
| Lithium hydroxide.hydrate | 4.1 | 4.1 | 4.1 | 6.7 | 4.1 | 4.1 | 3 | 4.2 |
| (Phosphate ester/phosphite ester) | | | | | | | | |
| Tricresyl phosphate | | | | 5 | 3 | 3 | 5 | |
| Tributyl phosphate | 5 | | | | | | | |
| Triphenyl phosphite | | 5 | 5 | | 2 | 2 | | |
| Dropping point of a grease produced in each example | | | | | | | | |
| (°C.) | over 260 | over 260 | over 260 | over 260 | 264 | 238 | 190 | 216 |
| (°F.) | over 500 | over 500 | over 500 | over 500 | 507.2 | 460.4 | 374 | 420.8 |
| [JIS K-2561 Test] | | | | | | | | |

As seen from Table 2, each lithium complex grease obtained in Examples 3 to 8 maintains a high dropping point of more than 230° C. (446° F.). In comparing with such a high dropping point of the greases obtained in Tests 1, 2 (conducted within the scope of U.S. Pat. Nos. 2,872,417 and 2,898,296 respectively) is less than 220° C. Accordingly, the greases according to this invention are much superior to the conventional greases.

Now, two experiments of a new grease produced by the Example 1 of this invention will now be described while comparing with the conventional greases.

EXPERIMENT 1

Two kinds of amine oxidation inhibitors, one metal passivator and one rust inhibitors were, as additives, added to the lithium complex grease obtained in the Example 1, whereby an experimental grease had been produced. 0.16 grams of this experimental grease was supplied into a ball bearing (NSK Type No. 627, bore diameter: 7 mm, outside diameter: 22 mm, width: 7 mm) and sealed therein. Further, 0.10 grams of this experimental grease was supplied into another ball bearing (NSK Type No. 607, bore diameter: 7 mm, outside diameter: 19 mm, width: 6 mm) and sealed therein. The above two ball bearings were incorporated into a motor, wherein the temperature of the outer rings was controlled to 135° C. (275° F.), and the inner rings were rotated with the rotation speed: 2,800 r.p.m. under an application of thrust load 2 kg.

Concerning the grease life, we had the criteria of judgement that the limit of the grease life is when the temperature of the outer rings became 145° C. (293° F.) with an increase of 10° C. (50° F.), and we measured the lapse of time from 135° C. to 145° C. Speaking more in detail about our criteria, when the grease in the ball bearing is deteriorated, its rotary torque becomes excessive and the input current of the motor exceeds the limit current. Thus, the grease lubrication is deteriorated and the temperature of the outer ring for ball bearings is increased to 145° C. (293° F.) with an increase of 10° C. (50° F.). This is the limit of the grease life. According to our past experiences, it is possible to value the grease quality by measuring the lapse of time up to raising of 10° C.

In Table 3 there is shown the comparison of the life duration of the grease according to Example 1 with that of a conventional high temperature urea non-soap grease.

TABLE 3

| Life Duration in the Bearing Test at 135° C. (275° F.) | |
|---|---|
| Greases | Life duration (hours) |
| Grease according to this invention | 1,218–1,321 |
| Conventional high temperature urea non-soap grease | 510–527 |

EXPERIMENT 2

1.3 grams of the experimental grease produced in the Experiment 1 were supplied into a ball bearing (NSK Type No. 6908, bore diameter: 40 mm, outside diameter: 62 mm, width: 12 mm) and sealed therein. The above ball bearings were incorporated in a motor wherein the temperature of the inner ring was set to 140° C. (284° F.) and the outer rings were rotated with the rotation speed 6,800 r.p.m. under an application of radial load 20 kg. The main purpose of this Experiment is to test the adhesion property of the greases. Generally, when the ball bearing is rotated high-speedily, the grease therein is apt to be scattered. In other words, when outer rings are rotated, the grease must be adhered stably thereto. Otherwise, the grease life is reduced remarkably.

In Table 4 there is shown the comparison of the life duration of the grease according to Example 1 with that of the conventional greases.

TABLE 4

| Life Duration in the Bearing Test at 140° C. (284° F.) | |
|---|---|
| Greases | Life duration (hours) |
| Grease according to this invention | 1,136 |
| Conventional high temperature sodium | |

TABLE 4-continued

| Life Duration in the Bearing Test at 140° C. (284° F.) | |
|---|---|
| Greases | Life duration (hours) |
| grease | 227–274 |
| Conventional high temperature urea non-soap grease | 148–380 |

For reference, we show the following test data of the greases at the time when the temperature of the inner rings in the bearing amounted to 160° C. The greases are placed in severer conditions than before.

TABLE 5

| Life Duration in the Bearing Test at 160° C. (320° F.) | |
|---|---|
| Greases | Life duration (hours) |
| Grease according to this invention | 320–467 |
| Conventional high temperature sodium grease | 71–178 |
| Conventional high temperature urea non-soap grease | 54–191 |
| Conventional high temperature lithium complex grease | 125–183 |

The Experiment 1 is the test of the greases used under a high temperature in a small-sized bearing. Particularly, the conditions of the heat resistance property become severer year after year in case the greases are used in the bearings incorporated in the operating devices of a car. In this case, the grease must have more than 1,000 hour life duration.

On the other hand, the bearing which was used in the Experiment 2 is larger at size than that in the Experiment 1. The outer rings in the bearing are rotated by various electromagnetic clutches and positioned in the proximity of a power generating source like a coil. Accordingly, the greases are used in severe conditions and required to have a long life duration.

As mentioned previously, the greases according to this invention can overcome the foregoing severe use conditions and contribute to the extention of life and the betterment of reliability.

As described previously, the process of producing the lithium complex grease according to this invention is characterized in that the base greases are produced by mixing and dispersing a base oil, a fatty acid having 12 to 24 carbon atoms, a dicarboxylic acid having 4 to 12 carbon atoms and/or a dicarboxylic acid ester and a lithium hydroxide. Following to this, the base greases are added by a phosphate ester and/or a phosphite ester, and thickened under a reaction at a temperature of more than 210° C. (410° F.). Since the greases according to this invention have a high dropping point of more than 230° C. (446° F.), they can overcome sufficiently such severe conditions as a high-speed rotation of bearings or an outer ring rotary test.

In producing lithium complex grease according to the invention followiang proportions can be used:

$$\text{Ratio of } \frac{\text{Dicarboxylic acid and/or Dicarboxylic acid ester}}{\text{Fatty acid}} : \quad 0.4 \text{ to } 1.5$$

Phosphate ester and/or .phosphite ester: 3 to 6 weight percent

Lithium hydroxide: Sponifying equivalent of Fatty acid plus dicarboxylic acid ester.

The soap content in the grease is the data which were measured by adding the amount of fatty acid to the amount of the dicarboxylic acid and/or dicarboxylic acid ester, provided that LiOH is not contained therein.

Further, the greases according to this invention can maintain the duration of life exceeding 1,000 hours which are the limit of the grease life.

Still further, when the greases of this invention are used in the place of a very high temperature, they maintain a high adhesion and a high micell stability, so that they do not leak from the bearing. On the other hand, when they will be used in the conditions of a low temperature, a low torque or the like, it is possible to use such low/viscosity materials as a diester oil, a hindered ester oil, etc as a base oil. As a result, they can maintain a low temperature property, a low torque property, etc so that they have adaptability for a broad temperature range. It is, therefore, very suitable to use the greases according to this invention in the place having a broad temperature range, for example, in the proximity of a car engine.

Tables 6–8 show examples A to V illustrating various compositions of the grease of the invention, which have been tested in the experiments. The experiments were conducted under the condition of the dropping point of 230° C. or more at temperature.

TABLE 6

| | Example | | | | | | | |
|---|---|---|---|---|---|---|---|---|
| Composition | A | B | C | D | E | F | G | H |
| (Base oil) | | | | | | | | |
| Polyol ester oil | 62.5 | 62.4 | 60.1 | 60 | 63.4 | 66.9 | 59.6 | 61.9 |
| (Fatty acid) | | | | | | | | |
| Stearic acid | 21 | 20 | 20 | 18 | 15 | 12 | 12 | 10 |
| 12-hydroxystearic acid | | | | | | | | |
| (Dicarboxylic acid ester) | | | | | | | | |
| Di-2-ethylhexyl sebacate | 7 | 8 | 10 | 12 | 12 | 12 | 18 | 18 |
| (Dicarboxylic acid) | | | | | | | | |
| Sebacic acid | | | | | | | | |
| (Lithium hydroxide) | | | | | | | | |
| Lithium hydroxide.hydrate | 4.5 | 4.6 | 4.9 | 5.0 | 4.6 | 4.1 | 5.4 | 5.1 |
| (Phosphate ester/phosphite ester) | | | | | | | | |
| Tricresyl phosphate | 5 | 5 | 5 | 5 | 5 | 5 | 5 | 5 |
| Tributyl phosphate | | | | | | | | |
| Triphenyl phosphite | | | | | | | | |
| Dropping point of a grease produced in each example | | | | | | | | |
| (°C.) | 204 | 237 | 248 | 248 | 243 | over 260 | 232 | 202 |
| (°F.) | | | | | | | | |
| [JIS K-2561 Test] | | | | | | | | |
| Dicarboxylic acid (ester)/Fatty acid Ratio | 0.33 | 0.4 | 0.5 | 0.67 | 0.8 | 1 | 1.5 | 1.8 |

TABLE 6-continued

| Composition | Example A | B | C | D | E | F | G | H |
|---|---|---|---|---|---|---|---|---|
| Ratio = 0.4 ~ 1.5 | | | | | | | | |
| Dropping point 230° C. or more | | | | | | | | |

TABLE 7

| Composition | Example I | J | K | L | M | N | O |
|---|---|---|---|---|---|---|---|
| (Base oil) | 69.9 | 68.9 | 67.9 | 66.9 | 65.9 | 64.9 | 63.9 |
| Polyol ester oil | | | | | | | |
| (Fatty acid) | 12 | 12 | 12 | 12 | 12 | 12 | 12 |
| Stearic acid | | | | | | | |
| 12-hydroxystearic acid | | | | | | | |
| (Dicarboxylic acid ester) | 12 | 12 | 12 | 12 | 12 | 12 | 12 |
| Di-2-ethylhexyl sebacate | | | | | | | |
| (Dicarboxylic acid) | | | | | | | |
| Sebacic acid | | | | | | | |
| (Lithium hydroxide) | | | | | | | |
| Lithium hydroxide.hydrate | 4.1 | 4.1 | 4.1 | 4.1 | 4.1 | 4.1 | 4.1 |
| (Phosphate ester/phosphite ester) | 2 | 3 | 4 | 5 | 6 | 7 | 8 |
| Tricresyl phosphate | | | | | | | |
| Tributyl phosphate | | | | | | | |
| Triphenyl phosphite | | | | | | | |
| Dropping point of a grease produced in each example | | | | | | | |
| (°C.) | | | over | over | | | |
| | 207 | 231 | 260 | 260 | 253 | 201 | 194 |
| (°F.) | | | | | | | |
| [JIS K-2561 Test] | | | | | | | |

Phosphate ester.phosphite ester: 3 to 6 weight percent or 4 to 6 weight percent
LiOH: Sponifying equivalent of Fatty acid plus Dicarboxylic acid ester

TABLE 8

| Composition | Example P | Q | R | S | T | U | V |
|---|---|---|---|---|---|---|---|
| (Base oil) | | | | | | | |
| Polyol ester oil | 77.2 | 74.0 | 71.5 | 66.9 | 66.9 | 66.9 | 59.2 |
| (Fatty acid) | | | | | | | |
| Stearic acid | 8 | | 10 | 12 | 6 | 6 | 15 |
| 12-hydroxystearic acid | | 9 | | | 6 | 6 | |
| (Dicarboxylic acid ester) | | | | | | | |
| Di-2-ethylhexyl sebacate | 8 | 9 | 10 | 12 | 12 | 12 | 15 |
| (Dicarboxylic acid) | | | | | | | |
| Sebacic acid | | | | | | | |
| (Lithium hydroxide) | | | | | | | |
| Lithium hydroxide.hydrate | 2.8 | 3.0 | 3.5 | 4.1 | 4.1 | 4.1 | 5.2 |
| (Phosphate ester/phosphite ester) | | | | | | | |
| Tricresyl phosphate | 4 | 3 | 5 | 5 | 5 | | 5 |
| Tributyl phosphate | | | | | | | |
| Triphenyl phosphite | | 2 | | | | 5 | |
| Dropping point of a grease produced in each example | | | | | | | |
| | | | over | over | | over | over |
| (°C.) | 246 | 244 | 260 | 260 | 257 | 260 | 260 |
| (°F.) | | | | | | | |
| [JIS K-2561 Test] | | | | | | | |
| Dicarboxylic acid (ester)/ Fatty acid Ratio | 1 | 1 | 1 | 1 | 1 | 1 | 1 |

It will be understood that each of the components described above, or two or more together, may also find a useful application in other types of lithium complex greases differing from the types described above.

While the invention has been illustrated and described as embodied in a lithium complex grease, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lithium complex grease comprising:

59 to 78 weight percent of a base oil;

16 to 30 weight percent of a mixture of a dicarboxylic acid of from 4 to 12 carbon atoms, an ester of the dicarboxylic acid of from 4 to 12 carbon atoms or mixtures thereof and a fatty acid of from 12 to 24 carbon atoms;

an equivalent amount of lithium hydroxide for saponifying the dicarboxylic acid, the ester of the dicarboxylic acid or mixtures thereof and the fatty acid; and 3 to 6 weight percent of a phosphate ester, a phosphite ester or mixtures thereof, the ratio of the dicarboxylic acid component to the fatty acid component ranging from 0.4 to 1.5 based upon weight.

2. A grease according to claim 1 in which the fatty acid has 16 to 20 carbon atoms.

3. A grease according to claim 1 in which the fatty acid is a stearic acid.

4. A grease according to claim 1 in which the dicarboxylic acid has 6 to 10 carbon atoms.

5. A grease according to claim 1 in which the dicarboxylic acid is sebacic acid or azelaic acid.

6. A grease according to claim 1 in which the dicarboxylic acid ester is di-2-ethylhexyl sebacate or di-2-ethylhexyl azelate.

7. A grease according to claim 1 in which the phosphate ester is tricresyl phosphate.

8. A method of producing a lithium complex grease comprising mixing in from 59 to 78 weight percent of a base oil, from 16 to 30 weight percent of a mixture of a dixarboxylic acid of from 4 to 12 carbon atoms, an ester of said dicarboxylic acid or mixtures thereof and a fatty acid of from 12 to 24 carbon atoms to obtain a mixture, said mixture being saponified with an equivalent amount of lithium hydroxide necessary for saponification of the mixture and, subsequently, reacting the mixture thus obtained with from 3 to 6 weight percent of a phosphate ester, phosphite ester or mixtures thereof at a temperature greater than 210° C.

* * * * *